US010364945B2

(12) United States Patent
Roys et al.

(10) Patent No.: US 10,364,945 B2
(45) Date of Patent: Jul. 30, 2019

(54) ELECTRICAL WALL RECEPTACLE, LED MODULE, AND LAMP SYSTEM

(71) Applicants: Curtis Alan Roys, Fredericksburg, TX (US); Sidney Howard Norton, Odessa, TX (US)

(72) Inventors: Curtis Alan Roys, Fredericksburg, TX (US); Sidney Howard Norton, Odessa, TX (US)

( * ) Notice: Subject to any disclaimer, the term of this patent is extended or adjusted under 35 U.S.C. 154(b) by 0 days.

(21) Appl. No.: 15/724,231

(22) Filed: Oct. 3, 2017

(65) Prior Publication Data

US 2018/0094779 A1 Apr. 5, 2018

Related U.S. Application Data

(60) Provisional application No. 62/404,160, filed on Oct. 4, 2016.

(51) Int. Cl.

| | |
|---|---|
| ***F21K 9/238*** | (2016.01) |
| ***F21K 9/235*** | (2016.01) |
| ***F21V 23/06*** | (2006.01) |
| ***H01R 13/66*** | (2006.01) |
| ***H01R 27/02*** | (2006.01) |
| ***H05B 33/08*** | (2006.01) |
| *F21K 9/232* | (2016.01) |
| *F21Y 115/10* | (2016.01) |
| *H01R 33/22* | (2006.01) |

(52) U.S. Cl.

CPC ..... *F21K 9/238* (2016.08); *F21K 9/235* (2016.08); *F21V 23/06* (2013.01); *H01R 13/665* (2013.01); *H01R 27/02* (2013.01); *H05B 33/089* (2013.01); *F21K 9/232* (2016.08); *F21Y 2115/10* (2016.08); *H01R 33/22* (2013.01)

(58) Field of Classification Search

CPC ..... F21K 9/235; F21K 9/238; F21V 25/04; H05B 33/089

See application file for complete search history.

(56) References Cited

U.S. PATENT DOCUMENTS

| | | | | |
|---|---|---|---|---|
| 3,809,882 A | | 5/1974 | Wetmore | |
| 4,386,333 A | | 5/1983 | Dillan | |
| 5,563,782 A | | 10/1996 | Chen et al. | |
| 6,160,728 A | * | 12/2000 | Peterson | H01R 13/6675 363/141 |
| 6,577,072 B2 | | 6/2003 | Saito et al. | |

(Continued)

FOREIGN PATENT DOCUMENTS

| | | | |
|---|---|---|---|
| WO | 2003017729 | A1 | 2/2003 |
| WO | 2011117674 | A3 | 11/2012 |
| WO | 2017019627 | A1 | 2/2017 |

*Primary Examiner* — Douglas W Owens
*Assistant Examiner* — Pedro C Fernandez
(74) *Attorney, Agent, or Firm* — Scheinberg & Associates, P.C.; Michael O. Scheinberg

(57) ABSTRACT

An electrical receptacle that is normally configured to receive AC voltage is configured to provide a low voltage DC instead. An LED bulb without a transformer can be plugged into the appliance and operate on the DC voltage from the wall outlet. An optional circuit interrupter can prevent damage to the LED bulb is it is inadvertently plugged into a source of AC voltage. Any appliance designed to be operated on DC voltage can be plugged into the DC outlet without a transformer. Multiple LEDs can be "piggybacked" onto a base.

5 Claims, 4 Drawing Sheets

(56) References Cited

U.S. PATENT DOCUMENTS 6,836,081 B2 12/2004 Swanson et al.
6,976,885 B2 12/2005 Lord
7,265,504 B2 9/2007 Grant
8,004,210 B2 8/2011 Harmgardt et al.
8,134,254 B2 3/2012 Makwinski
8,183,797 B2 5/2012 McKinney
8,212,386 B2 7/2012 Mahaffey
8,308,493 B2 11/2012 Lim et al.
8,400,131 B2 3/2013 Li et al.
8,414,153 B2 4/2013 Berta
8,441,216 B2 5/2013 Brownlee
8,446,099 B2 5/2013 McCune
8,545,039 B2 10/2013 Patel
8,610,313 B2 12/2013 Makwinski
8,674,622 B2 3/2014 Vigilante et al.
8,705,253 B2 4/2014 Roman
8,734,171 B2 5/2014 Cameron
8,742,680 B2 6/2014 Cowburn
8,754,594 B2 6/2014 Leak et al.
8,777,436 B2 7/2014 Labans
9,144,129 B2 9/2015 Munday et al.
9,225,126 B2 12/2015 Janfada et al.
9,232,593 B2 1/2016 Fischer et al.
9,265,119 B2 2/2016 Catalano et al.
9,391,412 B2 7/2016 Hewson et al.
9,425,536 B2 8/2016 Levante et al.
2003/0151917 A1 8/2003 Daughtry et al.
2004/0218411 A1 11/2004 Luu et al.
2005/0237005 A1 10/2005 Maxik
2007/0029879 A1 2/2007 Eldredge
2007/0127273 A1 6/2007 Tsai
2007/0153518 A1 7/2007 Chen
2010/0296290 A1 11/2010 Yang
2011/0069487 A1* 3/2011 Ng ..... H05B 33/0803 362/249.02
2011/0163681 A1* 7/2011 Dau ..... F21K 9/235 315/191
2011/0193488 A1 8/2011 Kanamori et al.
2012/0057370 A1 3/2012 Chien
2012/0120243 A1 5/2012 Chien
2012/0264316 A1* 10/2012 Cameron ..... H01R 29/00 439/188
2012/0319477 A1 12/2012 Brownlee
2013/0201658 A1* 8/2013 Bogart ..... F21S 4/001 362/95
2013/0328493 A1 12/2013 Munday
2014/0036505 A1 2/2014 Barton
2014/0191580 A1 7/2014 Fischer et al.
2014/0220800 A1 8/2014 Quezada
2014/0322983 A1 10/2014 Kim
2015/0092449 A1* 4/2015 Demuynck ..... H05B 33/0803 362/649
2015/0340826 A1 11/2015 Chien
2016/0055996 A1 2/2016 Quezada
2016/0091196 A1 3/2016 Chien
2016/0226178 A1 8/2016 Byrne et al.

* cited by examiner

ELECTRICAL WALL RECEPTACLE, LED MODULE, AND LAMP SYSTEM

This application claims priority from U.S. Prov. App. No. 62/404,160, filed Oct. 4, 2016, which is hereby incorporated by reference.

TECHNICAL FIELD OF THE INVENTION

The present invention relates to electrical receptacles and LEDs or other low voltage, DC lighting.

BACKGROUND OF THE INVENTION

The lighting industry is quickly changing from fluorescent and incandescent light bulbs to a more efficient method, such as light emitting diodes (LEDs) to light the world's commercial and residential segments. Current light emitting diode (LED) technologies, such as LED light bulbs, LED strip lighting, and LED modules operate on direct current (DC), and thus require a transformer or other converter to convert typical AC (alternating current) mains power into the DC (direct current) required to power the diodes. As LED technology is adopted, many fixtures which currently operate with old light sources, such as incandescent and fluorescent bulbs, are being replaced with LEDs. AC mains voltage is typically 120 V or 240 V, depending on the country. This voltage is too high to directly connect to the one or more diodes. Because the new LED lighting cannot be connected directly to AC power, one or more transformers or converters must be installed or included within the housing when implementing LED light sources.

In the current residential market, there are many options for LED replacement light bulbs, which fit into the standard Edison screw base socket, which supplies AC at mains voltage. Replacement LED bulbs incorporate a transformer or other power conversion circuitry in the housing of the bulb, typically within a cavity in the base of the bulb.

An LED replacement bulb, while vastly more efficient than an incandescent bulb it may be replacing, will generate significant heat. Both the diodes themselves, and the power converter generate waste heat, which is typically dissipated through a heatsink. In some designs, the exterior of the housing is used as a heat sink. Because of aesthetic considerations, large, efficient heatsinks are normally not used. The result is that the operating temperature of the bulb, is relatively high. While the diode junctions themselves are designed to be tolerant of high operating temperature, the circuitry providing DC voltage to the LED will experience extreme temperatures relative to its design. Heat-induced failure of the DC voltage supply is a common failure mode of such bulbs.

Typical LED replacement bulbs have a rated lifespan of 30,000-50,000 hours. However, the rating is based on the diode lifespan, rather than the bulb as a whole. Often, the DC power supply will fail long before the bulb reaches the rated lifespan.

Due to the limited space available within the bulb for electronics, it is not feasible to implement a larger, more robust power supply. Even if a larger power supply could be used, the issue of heat would still arise, due to the proximity of the (hot) LED units. For the bulb to fit within the base, and be aesthetically pleasing, the power supply must be internal.

Some LED lamps operate with an external power converter, which plugs into a standard AC receptacle and provides a better thermal environment for the electronics inside, by virtue of being external to the hot bulb. However, such "wall warts" and inline power adapters are bulky and unsightly, as well as often incompatible with each other due to the use of proprietary connectors.

Typical lamps supply voltage to the bulb mounts via simple wires connecting the terminals in the wall receptacle with the terminals in the mount, to supply the mains voltage to the socket. When plugged into a standard receptacle, the lamp supplies AC Receptacles with ports for AC and low voltage DC are known, however these have the disadvantage of requiring a different connector than the standard AC mains plug.

SUMMARY OF THE INVENTION

An object of the invention is to provide an improved electrical outlet, light bulbs and lighting system.

An electrical receptacle that is normally configured to receive AC voltage is configured to provide a low voltage DC instead. An LED bulb without a transformer can be plugged into the appliance and operate on the DC voltage from the wall outlet. An optional circuit interrupter can prevent damage to the LED bulb is it is inadvertently plugged into a source of AC voltage. Any appliance designed to be operated on DC voltage can be plugged into the DC outlet without a transformer. Multiple LEDs can be "piggybacked" onto a base.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the scope of the invention as set forth in the appended claims.

BRIEF DESCRIPTION OF THE DRAWINGS

For a more thorough understanding of the present invention, and advantages thereof, reference is now made to the following descriptions taken in conjunction with the accompanying drawings, in which:

FIG. 3 shows the internal components of an outlet;

DETAILED DESCRIPTION OF PREFERRED EMBODIMENTS

An electrical receptacle having the form factor of a standard AC receptacle includes a voltage transformer to provides a DC voltage output. An LED bulb is provided that can plug into a standard AC lamp socket without a transformer in the bulb.

The lighting system can be used with a conventional lamp, that is, a lamp having a plug configured to plug into wall outlet having a standard AC receptacle such as a NEMA 1 receptacle and having in the lamp an Edison-style lamp socket. A wall outlet having a NEMA 1 configuration provides a DC voltage to the lamp instead of an AC voltage, and an LED bulb inserted into the lamp socket is powered by the DC voltage provided. The LED bulb, lamp, or cord may include a circuit interrupter to prevent damage to the bulb if the lamp plug is inadvertently plugged into an AC power source. Alternatively, the circuit interrupter may be installed in the lamp or onto the lamp plug.

While the outlet and lamp system are described herein with respect to United States electrical standards, such as NEMA 1 and NEMA 5, the components and systems are applicable to any system that provide ACs power through outlets to power household appliances. The AC electricity supplied from the power lines is referred to as "line" or "AC mains" voltage or power. Also, the bulb socket is described as an Edison-type bulb socket, but any type of bulb socket can be used, particularly one that is designed to provide line voltage to an incandescent bulb.

Such an electrical wall receptacle allows the use of existing lamps or other lighting fixtures with a suitable low voltage, DC bulb. Low voltage, as used herein, means less than 50 VDC and preferably 24 VDC, 12 VDC, or 5 VDC. In addition, devices such as portable phone chargers or computer equipment could use the DC receptacle.

Figure 1:
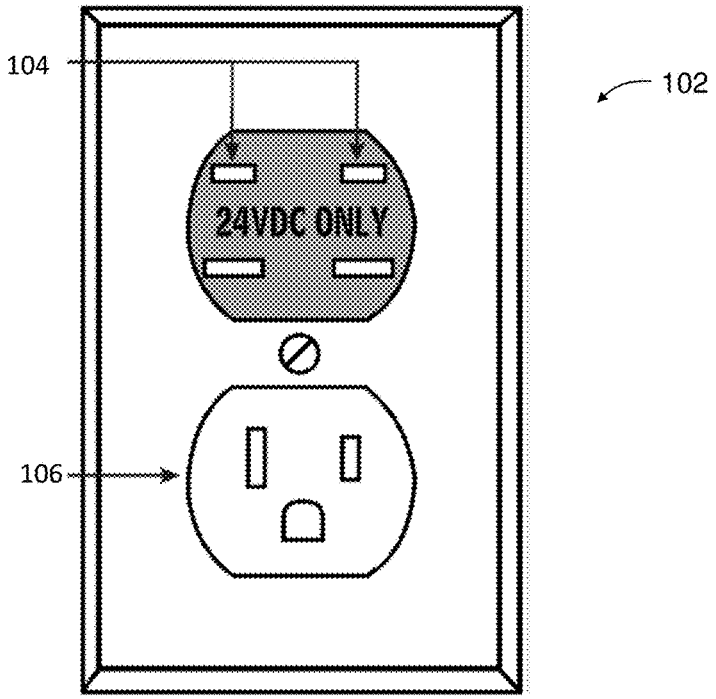
FIG. 1 shows a US style outlet having both AC and DC receptacles.

In describing an outlet, we refer to the long direction of the outlet as "vertical" even though it is understood that the outlet may be mounted in any orientation on a wall. A receptacle may also include a standard AC three-prong receptacle, oriented with the two blades vertical and the ground prong centered below, while the DC receptacle uses a two-prong configuration, but the DC receptacle may be rotated at an angle, for example 90°, with respect to the vertical. FIG. 1 shows an example outlet 102, with rotated 2-prong DC receptacles 104 and AC receptacle 106.

While some embodiments have one AC receptacle with one or more DC receptacles arranged above each other, other configurations and combinations of AC and DC receptacles is possible as well. An outlet may lack any AC receptacle and just provide DC voltage through on or more receptacles. Also, electrical receptacles are often "ganged" in a single wall-mounted electrical box, allowing multiple receptacles, sometimes in combination with switches, timers, or motion sensors.

To supply DC to the DC receptacle or receptacles, an AC-DC converter is used. A number of types of AC-DC converters are known in the art, such as switching power supplies or rectified transformers. For example, U.S. Pat. Nos. 6,836,081, 7,265,504 WO2003017729, and U.S. Pat. No. 8,400,131 all describe power sources for LEDs. The AC-DC converter may be housed within the body of the outlet, where it will be contained within the electrical box within the wall. It could also be mounted outside the electrical box. Rather than being hard-wired into the outlet, it could plug into the AC wall receptacle and output DC voltage. The voltage converter could also be incorporated into a power strip or extension cord that plugs in to the AC receptacle.

FIG. 3 shows a view of the internal components in a receptacle 302. Line voltage AC is applied to terminals 304 and 306. Note that in regions using 120 V AC, one terminal will be neutral, while the other is hot. Other configurations are possible. Typically, the smaller blade on the plug is inserted into the hot terminal and the wider blade is inserted into the neutral terminal. AC-DC converter 308 receives AC and outputs DC to a connection 314 to the contacts within contact openings 316*a* and 316*b* in the DC receptacle 318. The polarity of the contact in openings 316*a* and 316*b* are coordinated with the polarity of the electrical plug on the lamp cord, the polarity of the Edison socket, and the polarity of the LEDs. That is, the positive voltage from the AC-DC 308 converter is conducted to the positive input of the LED and the negative voltage from the AC-DC converter is conducted to the negative input of the LED.

For example, in the US, the wider spade on the plug is the neutral contact which is connected to the circular metal screw base contact of the Edison socket, whereas the narrower spade contact on the plug is connected to the center contact at the bottom of the Edison socket. In one embodiment, the positive output of AC-DC 308 converter is connected to the contact within smaller contact opening 316*a*, which would be connected through the polarized plug on the lamp cord to the circular metal screw base contact of the Edison socket, which would be connected to the positive DC voltage input of the LED. The negative output of AC-DC 308 converter is connected to the contact within wider contact opening 316*b*, which would be connected through the polarized plug on the lamp cord to the contact in the bottom of the Edison socket, which would be connected to the negative DC voltage input of the LED. Alternatively, the polarities could be reversed.

The portion 312 of the receptacle housing the AC-DC converter is installed within a wall, and not visible to a user after installation. AC receptacle 310 receives AC directly from terminals 306 and 304. Note that grounding is not shown in FIG. 3 for clarity.

The voltage available at the DC receptacle could either be fixed or variable, with 5 V, 12 V, and 24 V being common DC voltages for household use. Other voltages are possible as well.

Figure 2:
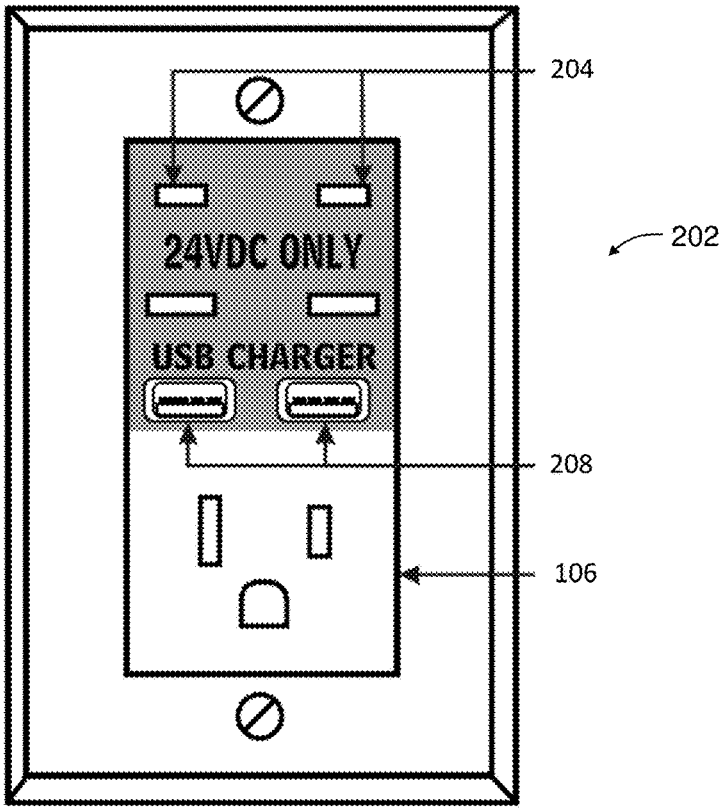
FIG. 2 shows a US-style outlet having AC, DC, and USB (universal serial bus) receptacles.

Additionally, other DC output ports may also be located on the receptacle, such as USB ports. Such ports output DC for existing DC devices. FIG. 2 shows a receptacle 202 with 2-prong DC ports 204, USB ports 208, and an AC receptacle 106.

The orientation of the DC receptacle could be used to indicate the difference in available voltage, particularly when there is also an AC receptacle for comparison. The receptacle supplying DC may also be colored differently than the AC receptacle to alert the user. For example, the portion of the AC receptacle visible to the user could be white, while the portion of the DC receptacle visible to the user is green. Additionally, the DC receptacles could be identified by a written or pictorial description. Any method that alerts the user that the plug is providing a voltage different from standard line voltage could be used. In some embodiments, the arrangement of receptacles indicates the difference in provided voltage. For example, a standard wall receptacle common in homes has two three-prong AC receptacles, one above the other. In one embodiment, one of the three-prong receptacles is replaced by two two-prong DC receptacles. In the US, lamps typically use a two-pronged plug without a ground plug. The lack of a grounding pin allows both DC receptacles to fit in the space one three-pin AC receptacle occupies, with the close spacing and lack of ground pins indicating to the user that these receptacles provide DC.

In some embodiments, outlets may take either the "standard" configuration, with the faceplate covering the area between receptacles, or the "contemporary" receptacle, where the faceplate has a rectangular opening and does not cover the area between the two receptacles. In some embodiments, the space between receptacles is used for additional ports, such as USB ports.

Another embodiment is an LED bulb for use in a lamp, operated on DC. While the bulb has a standard mount for installation in sockets commonly used for AC, the bulb is configured to operate on DC.

Many kinds of bulb sockets are known and are suitable for use, such as Edison screw base or bi-pin connections, both available in various sizes. Other types of mounts may also be used.

Because the bulb is configured for low voltage DC, yet uses the same socket as AC is usually supplied to, in some embodiments, an interrupter is provided within the bulb elsewhere in the circuit to protect the bulb (and possibly the user) in the case that the DC bulb is inadvertently inserted into a receptacle supplying AC. The interrupter may be a resettable fuse, circuit breaker, protection circuit, or other type of overvoltage or overcurrent protection. The interrupter may be automatically resetting, or manually resettable. A consumable fuse could also be used.

In some embodiments, the interrupter is preferably integrated into the screw base of the LED bulb. It could also be incorporated elsewhere in the circuit. For example, the lamp cord could plug into the interrupter, which could then plug into a wall outlet. The interrupter could be clipped to the lamp cord so that it does not stay in the wall outlet when the lamp cord is removed. In another embodiment, the protector can screw into the Edison socket, and then the LED bulb can screw into the protector. That is, the protector can be integrated into the LED bulb or can be a separate element.

Figure 4:
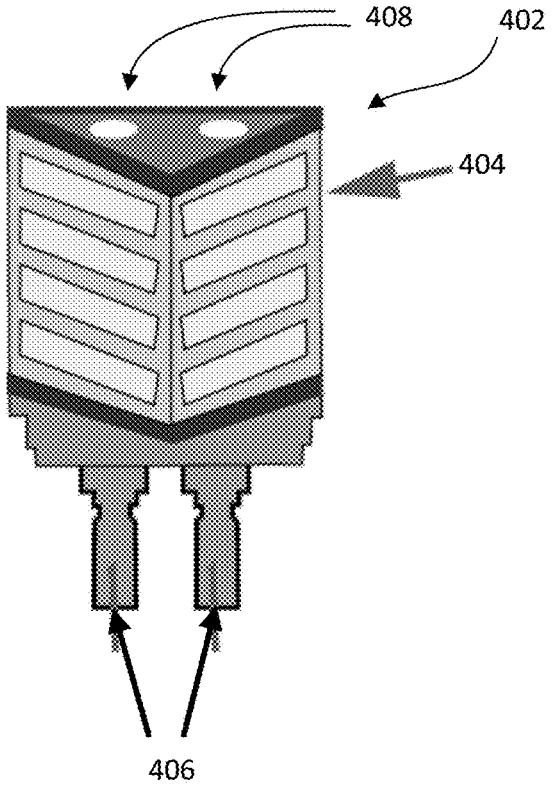
FIG. 4 shows an LED module.
Figure 5:
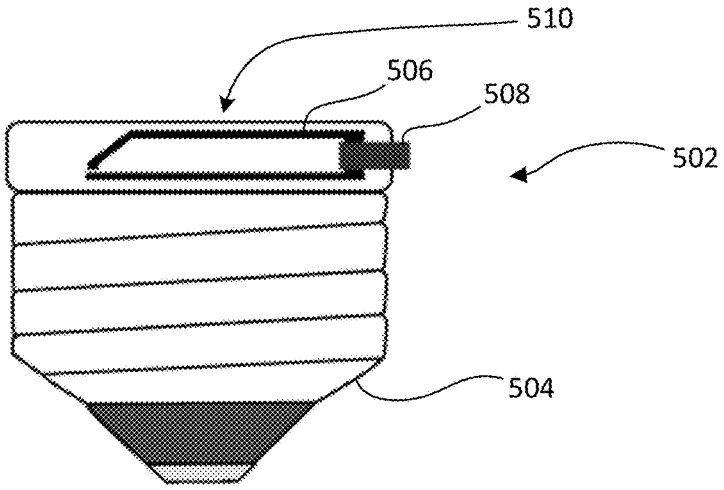
FIG. 5 shows an Edison socket base.

In some embodiments, the bulb takes the form of a two-part assembly, a base which interfaces with and receives power from the socket, and LED modules which are inserted into the base. An example is a screw-base, which installs into a standard screw mount, into which bi-pin LED modules can be inserted. FIG. 5 shows an Edison-mount base 502. The base interfaces with the socket through a standard Edison mount 504. Interrupter 506 is housed within the screw mount, and has an indicator 508 to indicate to the user that the circuit has been interrupted. The top of the base has a socket 510, not visible, which allows insertion of devices, for example the LED module of FIG. 4.

Figure 7:
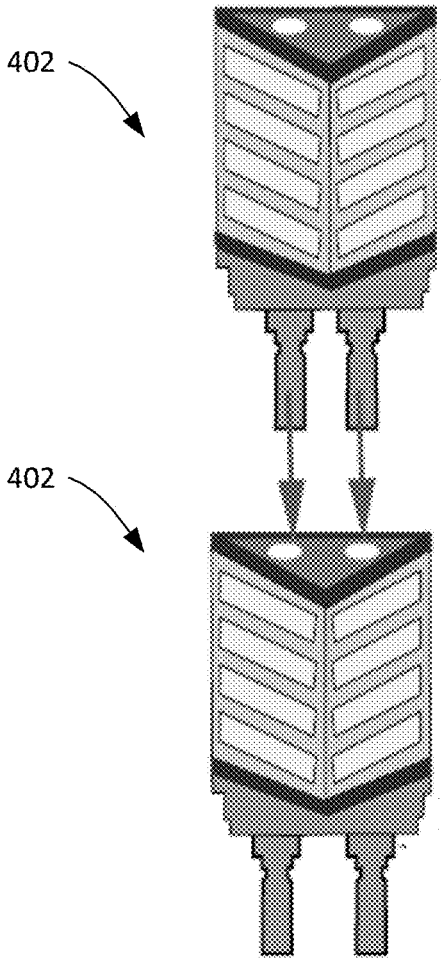
FIG. 7 shows how the LED modules stack to provide any number of LEDs to provide the needed light output.

In some embodiments, the LED module has connections in multiple places, such as a male bi-pin on one end and a female bi-pin socket on the other end. Such a module allows "piggybacking", or stacking of modules, with all receiving power as shown in FIG. 7, which shows how LED modules 402 combine. Internally, the module may be configured to pass the DC power received from the base to the additional lamp socket in the module, in essence creating a parallel connection between the stacked LED modules. FIG. 4 shows an exemplary LED module 402. Diodes 404 are mounted in planar arrays on the body of the module to provide light. Pins 406 extend from the base of the module, for interface with a suitable pin socket. Pin socket 408 on the top of the module allow connection of additional modules inline. An LED module similar to that of FIG. 4 is described in PCT/US16/43914, which is hereby incorporated by reference.

Stacking modules 402, such as those shown in FIG. 7, may be provided with identical LEDs or with LED of differing color temperatures, various colors, and various illuminance. For example, if a module providing light output equivalent to that of a 100 W incandescent bulb is found to be insufficient, an additional module may be "piggybacked" to increase the light output. Similarly, if it is found that the color temperature is to warm or cool for the illuminated space, the emitted spectrum could be altered by "piggybacking" an additional module with a different color temperature. If colored LED are used, various colors could be mixed or blended through the use of multiple modules.

Various arrangements are possible for the module itself. In some embodiment, the diodes are arranged in planar arrays on the sides of an elongated prism, with terminals on the ends. Other arrangements of terminals and diodes are possible, depending on the requirements of the application in which they will be used.

Figure 6:
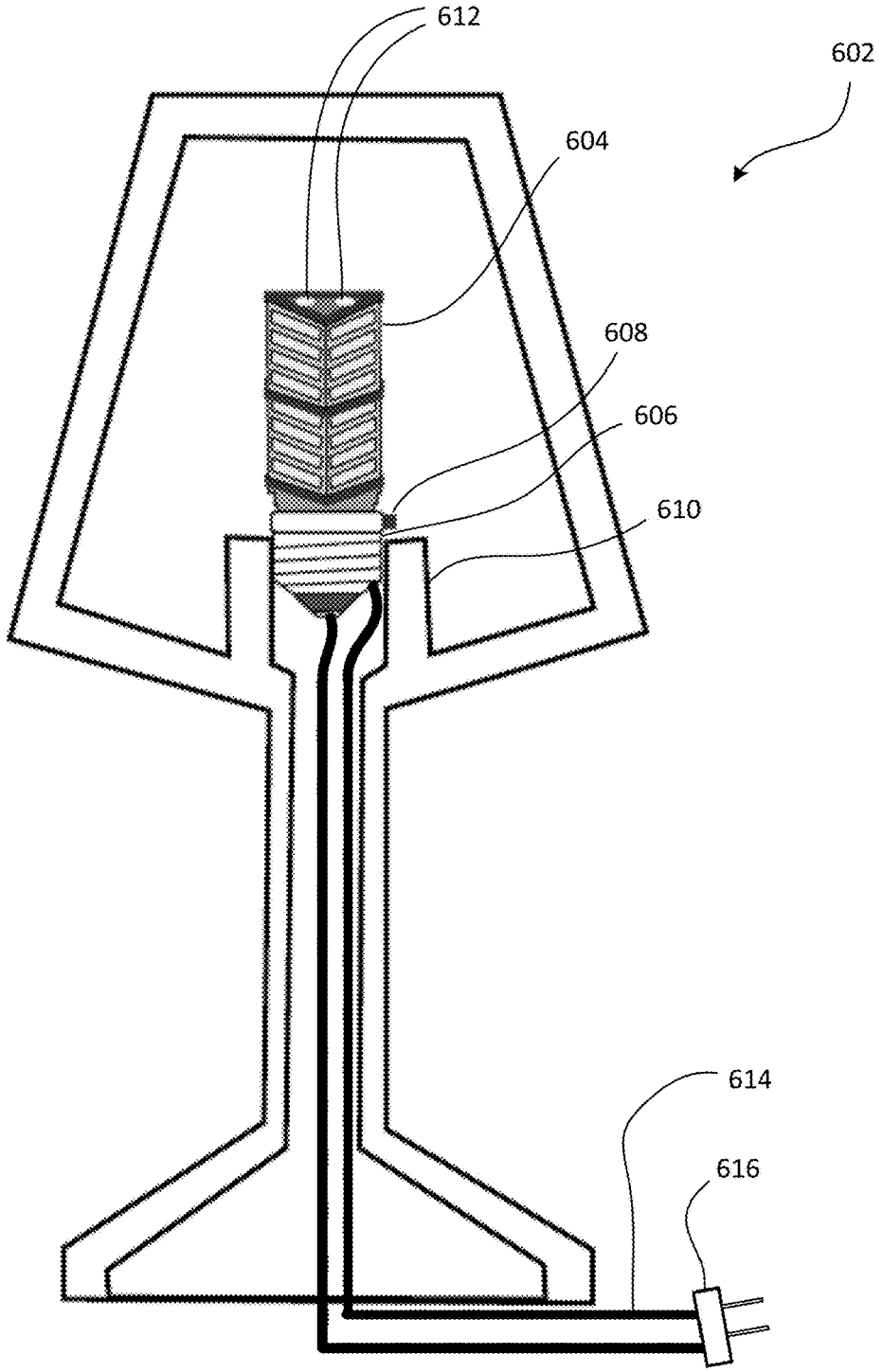
FIG. 6 shows a standard lamp with an LED bulb in the lamp socket.

FIG. 6 shows a typical lamp 602 with an Edison-mount socket 606 and LED module 604 installed. Lamp 602 could be a table lamp or a floor lamp. Other embodiments may comprise a wall-mounted plug-in lamp. In this embodiment, the interrupter indicator 608 is located such that it protrudes above the Edison mount, allowing it to remain visible when the base is inserted into socket 610. The lamp plugs in to a receptacle, such as that of FIGS. 1 and 2, through a 2-prong plug 616, with conductors 614 simply connecting the terminals on the Edison mount to the corresponding prongs on the plug 616. In this arrangement, if the light from LED module 604 is deemed insufficient, additional modules may be stacked by using sockets 612 on the top of LED module 604.

By NEMA 1-style receptacle is meant a receptacle having two parallel slots for receiving a plug and by NEMA 5-style receptacle is meant a receptacle having two parallel slots and a ground plug receiving hole having a circular cross section. To be a "NEMA X-style" receptacle does not require strict adherence to the NEMA X standard. The system is not limited to LEDs or to lighting application and can be used with any device using low voltage DC power.

A preferred method or apparatus of the present invention has many novel aspects, and because the invention can be embodied in different methods or apparatuses for different purposes, not every aspect need be present in every embodiment. Moreover, many of the aspects of the described embodiments may be separately patentable. The invention has broad applicability and can provide many benefits as described and shown in the examples above. The embodiments will vary greatly depending upon the specific application, and not every embodiment will provide all of the benefits and meet all of the objectives that are achievable by the invention.

In the following discussion and in the claims, the terms "including" and "comprising" are used in an open-ended fashion, and thus should be interpreted to mean "including, but not limited to . . . ." To the extent that any term is not specially defined in this specification, the intent is that the term is to be given its plain and ordinary meaning. The accompanying drawings are intended to aid in understanding the present invention and, unless otherwise indicated, are not drawn to scale.

The various features described herein may be used in any functional combination or sub-combination, and not merely those combinations described in the embodiments herein. As such, this disclosure should be interpreted as providing written description of any such combination or sub-combination.

Although the present invention and its advantages have been described in detail, it should be understood that various changes, substitutions and alterations can be made to the embodiments described herein without departing from the scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

We claim as follows:

1. A lighting system comprising:

an electrical receptacle mounted in a wall and having a form factor for accepting NEMA 1 style plugs or NEMA 5 style plugs, the receptacle outputting DC voltage; and a lamp including:

a power cord for plugging into the receptacle and receiving the DC voltage;

a bulb socket for receiving a bulb; and an LED bulb assembly connected to the lamp through the bulb socket, the LED bulb assembly including at least one LED and lacking a converter for converting line alternative current voltage into direct current voltage; and a circuit interrupter electrically connected between the distal end of the power cord and the one or more LEDs, the circuit interrupter interrupting the circuit if the power cord is plugged in to an AC outlet, wherein the circuit interrupter is part of the LED bulb assembly.

2. The lighting system of claim 1 in which the electrical receptacle and the power cord are polarized to deliver DC voltage of the appropriate polarity to the LED bulb.

3. The lighting system of claim 1, wherein the LED bulb assembly further comprises:

a base compatible with an Edison-style light socket;

a first LED support extending from the base and supporting LEDs, the first LED support including a support socket; and a second LED support, the second LED support configured to plug into and extend from the support socket of the first LED support, the second LED support supporting additional LEDs.

4. The LED bulb of claim 3 in which the support socket is positioned on the end of the first LED support.

5. The LED bulb of claim 3 comprising at least one additional LED support—supporting multiple LEDs, and each of the LED supports plugged in to the previous LED support except for the bottom LED support which is plugged in to the base.

* * * * *